United States Patent [19]

Eriksson

[11] 4,339,084

[45] Jul. 13, 1982

[54] PULP REFINING APPARATUS WITH ADJUSTABLE TREATING GAP

[76] Inventor: Erik F. Eriksson, YmsenvUMLa/gen 9*I, S-121 42 Johanneshov, Sweden*

[21] Appl. No.: 178,462

[22] PCT Filed: Apr. 27, 1979

[86] PCT No.: PCT/SE79/00104

§ 371 Date: Dec. 28, 1979

§ 102(e) Date: Dec. 17, 1979

[87] PCT Pub. No.: WO79/01002

PCT Pub. Date: Nov. 29, 1979

[30] Foreign Application Priority Data

Apr. 28, 1978 [GB] United Kingdom ..... 17034/78

[51] Int. Cl.[3] ..... B02C 18/16

[52] U.S. Cl. ..... 241/37; 241/251; 241/259.2; 241/260.1; 241/261; 425/204

[58] Field of Search ..... 100/146, 150; 162/24, 162/26; 222/412; 366/84, 85; 198/625; 425/204; 241/232, 233, 260.1, 261, 259.1, 259.2, 259.3, 266, 251, 37

[56] References Cited

U.S. PATENT DOCUMENTS

| | | | |
|---|---|---|---|
| 2,713,460 | 7/1955 | Atkinson | 241/232 X |
| 4,154,408 | 5/1979 | Boling, Jr. | 241/232 X |

FOREIGN PATENT DOCUMENTS

| | | | |
|---|---|---|---|
| 2051885 | 7/1972 | Fed. Rep. of Germany | 425/204 |
| 314288 | 9/1969 | Switzerland . | |
| 1229894 | 4/1971 | United Kingdom . | |

*Primary Examiner*—Mark Rosenbaum

*Attorney, Agent, or Firm*—Witherspoon & Hargest

[57] ABSTRACT

A pulp refining apparatus of the type in which two intermeshing rotary screws are driven synchronously within a housing provided with a material inlet and a material outlet, the treated material passing from the inlet to the outlet while being compressively treated at a high dry-matter concentration between the intermeshing screw threads, has at least one of the screws arranged for pivotal swinging movement in relation to the other in a way permitting selective adjustment of the width of the treating gap between the intermeshing screw threads and selective control of the treating conditions to which the material is exposed.

10 Claims, 3 Drawing Figures

B
4
5
7a
9a
10
11
12
15
15a
15b
16
17
18
20
21
22
23
23a
23b
1
2
2a
2b
3
3a
3b
6
8
8a
9
25
26
27

PULP REFINING APPARATUS WITH ADJUSTABLE TREATING GAP

FIELD OF THE INVENTION

The present invention relates to pulp refining apparatus of the type in which two intermeshing rotary screws are driven synchronously within a housing provided with a material inlet and a material outlet, the treated material, in the first place cellulosic material such as pulp, passing from the inlet to the outlet while being compressively treated at a high dry-matter concentration of at least 12.5% and preferably at least 25% between the intermeshing screw threads.

BACKGROUND

Apparatuses of a similar kind form the object of British Pat. No. 1 229 894 and Swedish Pat. No. 314 288. While in the refiner construction according to British Pat. No. 1 229 894 the discharge outlet for the treated material is positioned around the ends of the screw shafts remote from the inlet, the construction according to Swedish Pat. No. 314 288 provides for adjustability of the discharge opening between a stationary outlet end-wall of the housing and a longitudinally shiftable housing portion. The present invention is in the first place but not exclusively intended to be used in connection with constructions in which the outlet is not associated with the end-wall of the housing remote from the inlet but is disposed laterally in the stationary housing.

SUMMARY OF THE INVENTION

The known type of such an intermeshing screw refiner with a stationary housing has been widely and successfully used in practice. Still it has some disadvantages inherent in its construction.

(1) Due to the fact that the two screw shafts are mounted in firm mutual positions without the possibility of a resilient displacement of the screws away from each other expensive break-downs are caused when for example over-sized screws and nuts happen to be introduced into the interspace between intermeshing screw threads together with the treated material.

If lumps of particularly high dry-matter content are introduced between the screw threads, momentous radial forces acting on the screw shafts in some cases have been the cause of breaking of such shafts. The unyielding construction also restricts the use of the machine to a more limited concentration range of the treated material.

As there is no adjustment possibility in case the screws in the initial assemblage of the machine touch each other, the requirements as far as manufacturing tolerances are concerned are unduly high.

(2) Another negative aspect of the conventional unyielding screw construction resides in the fact that the compression in the treating gap cannot be directly controlled. It is not either possible to adjust the width of the refining gap between the intermeshing screws. Such an adjustment possibility, however, is particularly desirable in order to permit such positive control of the gap width as may be required to compensate for wear of the screws during extended use.

The unyielding support of the shafts also renders the machine unsuitable for "in-line"-use.

(3) When the screw thread portions of the screws are to be exchanged (with the shafts proper left in the machine) simultaneous axial removal and insertion of both thread portions is required due to the intermesh between the screws. In addition, exchange of the screw-thread portions requires removal of parts of the housing and dismounting of the inlet connections.

All these disadvantages are avoided by the present invention which resides in providing a pulp refining apparatus of the type defined above with a construction as defined in the attached claims, the salient feature of which is an arrangement permitting pivotal swinging movement of at least one of the two intermeshing screws in the common central axis plane of both screws.

1. Due to the fact that the shafts can be separated from each other when the pressure between the screws increases, destruction of the machine is avoided when hard foreign bodies such as screws and nuts accidentally are introduced into the treating gap between the screws.

Also such lumps of pulp which during an interruption of the operation of the machine have been left within the conveyor leading to the machine and have dried to considerable hardness can no longer damage the machine because the shafts will move apart when dried pulp lumps enter into the treating gap.

If newly inserted treating screws touch each other due to manufacturing tolerances, the spacing between the shafts can be adjusted to the extent necessary to solve in a simple way a difficult problem encountered in prior-art machines.

2. With the construction according to the invention the treating gap is directly adjustable. If a uniform working of fibrous material is desired by means of a constantly maintained pressure on the material between the treating screws, such conditions can be realized by maintaining a constant pressure between the pivotally supported screw and the unyieldingly supported screw. With a radially movable screw shaft or with both screw shafts movable in this way a certain desired treating gap can be maintained for obtaining a certain desired compression of the fibrous material between the treating screws.

By working with a radially movable shaft or radially movable shafts for one or both screws the machine will be suitable as a refiner immediately following the digester to perform what may be termed "in-line"-defibration. A machine having immovably mounted shafts lacks the necessary adaptability to all the variations and irregularities as may be encountered by a machine in this position. It may be mentioned in this connection that with the aid of laterally movable shafts compensation may be obtained for variations in the dry matter content of fibrous material. When the dry matter content diminishes, the shafts are urged together to reduce the width of the treating gap between the screws.

3. In the machine constructed in accordance with the invention the screws can be exchanged while the screw shafts remain in the machine. In a housing which in accordance with a secondary aspect of the present invention is composed of sections joined together along generally vertical planes extending in the axial direction of the screws, the side portions of the housing can be removed and the shafts separated at the ends remote from the driving connection to such an extent that the screw threads on both screws are disengaged from each other. Thereafter the screw cores carrying the screw threads can be separately removed from the respective shafts in an axial direction. The vertical division of the housing also has the favourable consequence that the upper and lower central portions of the housing can remain in their normal position during exchange of screw cores and/or shafts, which means that stationary connections leading to the inlet and/or outlet of the machine need not be detached.

While the problems previously mentioned thus are satisfactorily solved by the construction according to the present invention, a number of additional advantages are realized at the same time. For example, it is an advantageous feature that a position giver can easily be provided in connection with the swingable shaft to transmit a signal to a regulator controlling the pressure excerted on the swingable shaft and counteracting any outwardly swinging movement of this shaft. Hereby a desired treating gap can easily be adjusted and maintained in an automatic way.

Such regulator controlling the gap-closing bias can also in a common way receive an incoming control signal from the load of the drive motor when a uniform motor load is desired. The regulator then conveniently can be used to establish the desired motor load.

The invention is explained in greater detail by reference to the attached drawing.

DETAILED DESCRIPTION OF PREFERRED EMBODIMENTS

Figures 1, 2, 3:
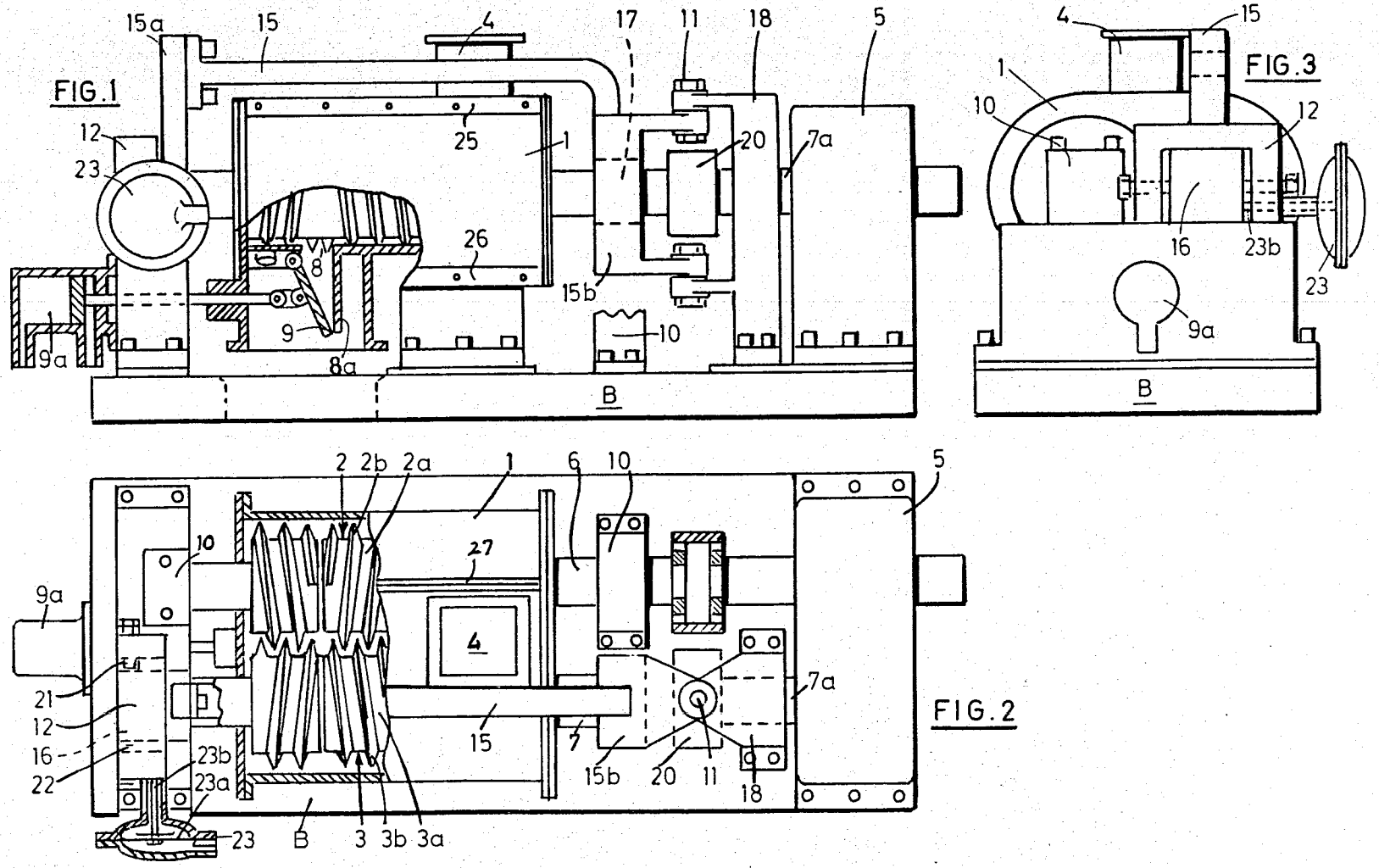
FIG. 1 is a partly sectioned side elevation of an apparatus constructed in accordance with the invention.
FIG. 2 is a plan view of the same apparatus partly in section and with parts broken away.
FIG. 3 is an end-view of the apparatus.

Two intermeshing screws 2 and 3 operate within a refiner housing 1. Each screw 2 and 3 has a cylindrical core 2*a* and 3*a* respectively, each such core carrying a treating screw thread 2*b* and 3*b*, respectively.

In accordance with a preferred embodiment forming the object of co-pending application Ser. No. 177,749 now abandoned having the same filling date as the present application, the treating screw thread on each screw is subdivided into two sections of mutually opposite pitch in such a way that during operation of the apparatus the right-hand section of each screw thread 2*b* and 3*b* as seen in FIGS. 1 and 2 will perform a feeding action from the right to the left, whereas the left-hand section will perform an action reversing the feeding action performed by the first mentioned section.

Material to be treated, e.g. cellulose pulp at a concentration in excess of 12.5%, preferably 25% or more, is supplied to the housing through an inlet 4 arranged in the housing substantially above the feed starting end of the feeding screw thread sections of both screw threads 2*b* and 3*b*. All the parts of the refiner, mentioned so far, are in a conventional way supported by a bed structure B.

Screw 2 is supported by a shaft 6 and screw 3 is supported by a shaft 7, both shafts 6 and 7 being driven in unison by a motor not shown via a gear unit 5.

A discharge aperture 8 extends through the bottom wall of the housing 1 centrally below the horizontally disposed pair of screws and at a position lengthwise of said screws 2 and 3 adjacent the terminal end of the feeding screw thread sections and the beginning of the feed-reversing screw thread sections of respectively screw threads 2*b* and 3*b*. The discharge aperture 8 is bounded by an outwardly extending sleeve 8*a*. An outlet-closing element such as a pivotably supported flap 9 is resiliently urged by means, here exemplified as cylinder and piston means 9*a*, towards a position in relation to the obliquely cut mouth opening of sleeve 8*a* in which flap 9 to a selective degree resists the discharge of material from discharge aperture 8. The purpose and way of operation of the outlet and outlet closing mechanism is described in the above mentioned co-pending application Ser. No. 177,749. It will be understood that this construction is no part of the present invention and that the invention is not limited to this type of discharge means which merely are described as the presently preferred construction of this part of the machine.

While shaft 6 of screw 2 is supported in a more or less conventional way in stationary bearings 10 carried by said bed structure B, shaft 7 carrying screw 3, in accordance with the present invention, together with its bearings 16 and 17 is pivotally supported at the driven end as at 11 and is shiftably supported at the opposite end in a stationary adjusting device 12 having the general form of a frame supported by bed B and controlling the amount of pivotal swinging movement of the shaft thereby permitting control of the width of the treating gap between the two screws 2 and 3.

While it is technically possible to realize this feature of the present invention by cardanically connecting the driven end of shaft 7 to the corresponding outlet shaft 7*a* of gear unit 5 and directly supporting the opposite end of shaft 3 in the adjusting device 12, it is preferred, as shown in the drawings, to support the whole shaft 7 in a yoke element 15 having a vertical portion 15*a* extending from shaft bearing 16 at the adjusting device 12 and running horizontally from the upper free end of said portion 15*a* above and alongside housing 1 towards the driven end of the shaft 7 which is supported in bearing 17 carried within a vertical fork-shaped end portion 15*b* of yoke 15, said end portion 15*b* at the free ends of its fork arms being hingedly connected to corresponding fork arms extending from a stationary upright supporting structure 18 to form fulcrum means constituting the previously mentioned pivotal support 11.

The necessary cardanic mobility of shaft 7 in relation to the output shaft 7*a* of gear unit 5 is realized in a coupling 20 between these two parts in any conventional way, it being understood that the degree of pivotal displacement of shaft 7 in relation to output shaft 7*a* of motor and gear unit 5 will be very small. By way of example it may be mentioned that commercially available, cardanically movable gear couplings will permit $\pm 2°$ angular deviation for each movable half of the coupling.

Adjustable stops 21 and 22 are provided in adjusting device 12 to define the least and largest permissible treating gap between the intermeshing screws 2 and 3. As the lateral adjustability of shaft 7 will require a passage of increased dimensions through the end-wall of the housing at least at the outlet end, a conventional packing such as a bellows (not shown) may be provided around shaft 7 on the outside of the end-wall of the housing 1 in such a way as to prevent treated material from leaving the housing around shaft 7.

The pivotable shaft 7 is urged towards the adjustable stop 21 defining the minimum working space between the screws by pneumatic, hydraulic, counterweight or spring means. The means illustrated in the drawings is a pneumatic or hydraulic diaphragm means 23 of conventional design permitting application of hydraulic or pneumatic pressure to the outer surface of a diaphragm 23*a*, the inner surface of which carries a stub shaft 23*b* having a free end in contact with bearing 16 which in turn is supported within the frame opening of stationary adjusting device 12 for lateral displacement in the common central longitudinal plane of shafts 6 and 7.

The improvement achieved by the pivotal suspension of one of the screws is further exploited by the provision of at least one vertical subdivision of the housing 1 as shown by mounting flange connections 25, 26 permitting removal of substantially half the lateral housing wall on either side of the housing. While flange connection 25 is not visible in FIG. 2 due to its position below yoke 15, FIG. 2 shows another similar flange connection 27 on the opposite side of the housing. The said mounting flange connections 25, 26 etc. preferably lie in the same vertical plane as the axis of the screw shaft on the same side of housing 1.

The way of operating the apparatus described above is as follows:

Cellulose pulp having a concentration in excess of about 12.5%, preferably in excess of 25% is introduced through inlet 4 and is fed forward by the intermeshing screw threads 2*b* and 3*b* while being simultaneously compacted and treated during transfer towards discharge aperture 8. In order to obtain an uniform and desired treatment of fibrous material it is necessary to control the pressure exerted on the pulp enclosed between the two treating screws 2 and 3 and the housing 1. As at least one of the screw shafts, such as shaft 7, is pivotally mounted at the driving end as described, whereas the other end of shaft 7 is laterally shiftable towards and away from the stationary screw shaft 6, the adjusting device 12 as described above may be used to urge the pivoting shaft 7 against the stationary shaft 6 to establish a desired compression in the treating gap. Stop 21 prevents the screws from touching each other by limiting the inward swinging movement of screw 3 and thereby defining the least permissible treating gap between the intermeshing screws 2 and 3. If the pressure exerted unto the pulp enclosed between the screws tends to increase, for example due to the fact that the dry-matter concentration of the pulp supplied increases, the screws are pushed apart from each other. In this case the pressure prevailing between the treating screws is greater than the radial pressure exerted by diaphragm means 23. If the pressure to which the pulp enclosed between the screws is subjected tends to decrease below the pressure to which diaphragm means 23 is adjusted, the screws are again urged together. In this way a constant pressure is maintained on the pulp enclosed between the screws.

Obviously, the pressure control means, such as diaphragm means 23, may also be adjusted in a way causing the pulp to be refined in a more or less intensive way for specific purposes.

I claim:

1. Apparatus of the type used for treating cellulose pulp, comprising two intermeshing rotary screws (2, 3) having shafts (6, 7) associated therewith and driven synchronously within housing (1) having a material inlet (4) and a material outlet (8), said screws being provided with mutually intermeshing screw-thread sections (2*b*, 3*b*) compressively treating and conveying material from the inlet to the outlet at a high dry-matter concentration of at least 12.5% and preferably at least 25%, one end of at least one screw shaft (7) comprising a bearing (17) and being pivotally mounted relative to at least one output shaft (7*a*) for pivotal swinging movement of at least one screw (3) in a common central axial plane of both screws, the opposite end of said screw shaft (7) comprising a bearing (16) and being supported for lateral movement of said opposite end in said plane towards and away from said other screw shaft 6, said bearing (16) being supported for movement in said plane under the control of means (12, 21, 22, 23) selectively determining the width of the treating gap between the intermeshing screw-thread sections and selectively controlling the treating conditions to which the material is exposed.

2. Apparatus as claimed in claim 1, in which said bearing (17) is suspended in a fork (15*b*) which in cooperation with a complementary stationary fork element (18) constitutes a fulcrum member (11).

3. Apparatus as claimed in claim 2, in which both bearings (16, 17) of said pivotal screw (3) are supported by a yoke (15, 15*a*, 15*b*) extending lengthwise of said screw and incorporating said fork (15*b*) for swinging movement in a plane parallel to the common central axial plane of both screws (2, 3).

4. Apparatus as claimed in claim 1, in which an adjustable stop (21) limits the smallest treating gap between opposed surfaces of the intermeshing screw thread sections (2*b*, 3*b*).

5. Apparatus as claimed in claim 1, in which an adjustable stop (22) limits the largest treating gap between opposed surfaces of the intermeshing screw-thread sections (2*b*, 3*b*).

6. Apparatus as claimed in claim 1, in which a fluid-pressure actuated device (23) adjustably urges the swinging end of the pivotal screw (3) against an adjustable treating-gap limiting stop (21).

7. Apparatus as claimed in claim 1, including means to urge the pivoting end of the pivotal screw against an adjustable treating-gap limiting stop.

8. Apparatus as claimed in claim 1, in which a universal joint coupling (20) is interposed between said bearing (17) and said output shaft (7*a*) of the pivotal screw (3) in line with the pivoting axis.

9. Apparatus as claimed in claim 1, in which the housing (1) is composed of sections joined together along generally vertical planes extending in the axial direction of the screws.

10. Apparatus as claimed in claim 9, in which said vertical planes extend on either side of the material inlet.

* * * * *